US011015290B2

(12) United States Patent
Erren et al.

(10) Patent No.: US 11,015,290 B2
(45) Date of Patent: May 25, 2021

(54) METHOD FOR PRODUCING BLEACHED WOOD FIBRE MATERIAL

(71) Applicant: BASF SE, Ludwigshafen (DE)

(72) Inventors: Stefan Erren, Kallstadt (DE); Dieter Schönhaber, Meckenheim (DE); Martin Schachtl, Buchh (DE); Pavel V. Osipov, Moscow (RU)

(73) Assignee: BASF SE, Ludwigshafen am Rhein (DE)

( * ) Notice: Subject to any disclaimer, the term of this patent is extended or adjusted under 35 U.S.C. 154(b) by 156 days.

(21) Appl. No.: 15/128,755

(22) PCT Filed: Mar. 13, 2015

(86) PCT No.: PCT/EP2015/055275

§ 371 (c)(1),
(2) Date: Sep. 23, 2016

(87) PCT Pub. No.: WO2015/144455

PCT Pub. Date: Oct. 1, 2015

(65) Prior Publication Data

US 2018/0216292 A1 Aug. 2, 2018

(30) Foreign Application Priority Data

Mar. 25, 2014 (EP) ..... 14161583

(51) Int. Cl.
*D21B 1/02* (2006.01)
*D21C 9/10* (2006.01)
*D21B 1/14* (2006.01)

(52) U.S. Cl.
CPC ..... *D21B 1/021* (2013.01); *D21B 1/14* (2013.01); *D21C 9/1005* (2013.01); *D21C 9/1057* (2013.01); *D21C 9/1063* (2013.01); *D21C 9/1089* (2013.01)

(58) Field of Classification Search
CPC ..... D21B 1/021
See application file for complete search history.

(56) References Cited

U.S. PATENT DOCUMENTS 3,981,765 A * 9/1976 Kruger ..... D21C 3/02 162/80
5,129,987 A * 7/1992 Joachimides ..... D21B 1/16 162/25
5,607,547 A * 3/1997 Nye ..... D21C 9/1089 162/26
5,879,510 A * 3/1999 Hagglund ..... D21B 1/021 162/19
7,758,720 B2 7/2010 Sabourin
8,282,773 B2 10/2012 Sabourin
2007/0256804 A1 11/2007 Garcis Espino et al.
2010/0181531 A1* 7/2010 Rahkola ..... C01D 7/07 252/188.22
2010/0224333 A1* 9/2010 Duggirala ..... D21B 1/021 162/26
2012/0085505 A1* 4/2012 Sabourin ..... D21B 1/02 162/68

FOREIGN PATENT DOCUMENTS

CA 2066316 A1 10/1992
CN 100546783 C 10/2009
EP 0509905 A1 10/1992
EP 0604088 A1 6/1994
GB 1404315 A * 8/1975 ..... D21C 9/1084
JP S63-303189 A 12/1988
JP H02-68377 A 3/1990
JP 2009-144314 A 7/2009
WO WO-9220855 A1 * 11/1992 ..... D21B 1/021
WO WO-9722749 A1 6/1997

OTHER PUBLICATIONS

Smook, Handbook for Pulp and Paper Technologists, 1992, Angus Wilde Publications, 2nd edition, chapter 11.*
Leask, Mechnical Pulping:Chapter X, 1987, Joint textbook Committee of the PAper Industry, p. 134.*
Fernando et al., Characterization of fiber development in high- and low consistency refining of primary mechanical pulp, 2013, Holzforschung, (Year: 2013).*
International Preliminary Examination Report with Annexes (in German) for PCT/EP2015/055275 dated Jun. 17, 2016.
International Search Report for PCT/EP2015/055275 dated Jun. 11, 2015.

* cited by examiner

*Primary Examiner* — Anthony Calandra
(74) *Attorney, Agent, or Firm* — Faegre Drinker Biddle & Reath LLP

(57) ABSTRACT

In a process for producing bleached mechanical woodpulp, said process comprising the steps of a) delaminating comparatively large particles of wood, which have optionally been pretreated with chemicals and/or water, into modified particles of wood,
b) grinding the modified particles of wood from a) in one or more refiners,
c) optionally treating the stalk obtained in step b) with oxidative or reductive bleaching agents, a composition Z is present during step a) and/or step b), said composition Z comprising one or more of the following components (Z1) to (Z3): a salt of dithionous acid $H_2S_2O_4$ (Z1), a dithionous acid or dithionous acid derivative generator compound (Z2), a salt of sulfurous acid (sulfite) plus sodium tetraborohydride (Z3) and also optionally additives (Z4).

14 Claims, No Drawings

METHOD FOR PRODUCING BLEACHED WOOD FIBRE MATERIAL

CROSS-REFERENCE TO RELATED APPLICATIONS

This application is a national stage application (under 35 U.S.C. § 371) of PCT/EP2015/055275, filed Mar. 13, 2015, which claims benefit of European Application No. 14161583.1, filed Mar. 25, 2014, both of which are incorporated herein by reference in their entirety.

The present invention relates to a process for producing bleached mechanical woodpulp, a process for producing paper or light-colored wood-base materials, bleached mechanical woodpulp and the use of bleached mechanical woodpulp for producing paper or wood-base materials, each as defined in the claims.

Mechanical woodpulp is produced in large amounts and is an important starting material for producing certain types of paper, such as newsprint paper, magazine paper or for producing board and card.

Processes for producing mechanical woodpulp per se (what are known as just "woodpulp" among those skilled in the art) are known and described for example in Papermaking Science and Technology, Book 5 "Mechanical Pulping", Second Edition, 2009, Paper Engineers' Association, Ed. Bruno Lönnberg (ISBN 978-952-5216-36-6), hereinafter also referred to as "Lönnberg".

In short, soft/coniferous woods or hard/nonconiferous woods are typically debarked, comminuted into smaller pieces, typically about 5 cm by 5 cm in size (also referred to as "hogged chips" herein and among those skilled in the art), and then ground in a refiner, typically at elevated temperature of for example 100 to 160° C. Suitable soft/coniferous woods and hard/nonconiferous woods are described for example in Lönnberg, chapter 5, in particular item 2. or item 2.2.1 (Softwoods), for example spruce, pine, fir, or item 2.1.2 (Hardwoods), for example poplar such as *Populus tremula, Populus tremuloides.*

The mechanical woodpulp thus obtained is also referred to herein and among those skilled in the art as thermomechanical pulp (TMP) and is described in Lönnberg, chapter 5, items 2.2.1 and 2.2.2. The corresponding process is typically referred to as TMP process.

TMP is typically bleached with bleaching chemicals in a subsequent step in order to obtain very white paper in subsequent processing. The bleaching chemicals used include, for example, oxidative substances such as hydrogen peroxide, salts of organic or inorganic peracids, for example percarbonate, or reductive substances, such as sulfinic acids, salts of sulfurous acid (sulfites) or salts of dithionous acid (dithionites).

Diverse TMP processes are described at length in Lönnberg, in particular in chapter 7 (TMP) and chapter 8 (Chemimechanical Pulping, such as CTMP etc.).

The operation of grinding the hogged woodchips in a refiner is one of the particularly energy-intensive operations in papermaking and thus has a crucial bearing on the economics of the papermaking process. Reducing refiner energy requirements therefore continues to be a particular concern.

J. Melzer and W. Auhorn say in their German-language paper "Refiner Treatment of Mechanical Woodpulp With Reductive Bleaching Chemicals" in Wochenblatt für Papierfabrikation, 114, 1986, No. 8, pages 257 to 260, that the addition of sodium dithionite into the first TMP refiner of a two-stage TMP plant for non-woodfree printing paper leads to an energy saving as well as to good bleaching. A delaminating pretreatment of hogged chips before the refiner step is not disclosed therein.

Both energy saving and bleaching performance in the production of mechanical woodpulp remain in need of improvement.

The problem addressed by the present invention was that of reducing the level of energy consumption—preferably in the refiner—in the production of bleached mechanical woodpulp and at the same time, if possible, increasing the brightness of mechanical woodpulp without adversely affecting further important properties—mechanical properties, for example—of the paper fabricated out of the mechanical woodpulp.

The problem was solved as per the processes defined in the claims, the bleached mechanical woodpulp defined in the claims and the bleached mechanical woodpulp use defined in the claims.

Mechanical woodpulp and its production is known and described for example in Lönnberg, in particular in chapters 4, 6, 7, 8 and 15.

The starting material for the mechanical woodpulp of the present invention comprises soft/coniferous woods and hard/nonconiferous woods. These woods are described for example in Lönnberg, chapter 5, in particular item 2. or item 2.2.1 (Softwoods), for example spruce, pine, fir, or item 2.1.2 (Hardwoods), for example beech, birch, *eucalyptus* or poplar, such as *Populus tremula, Populus tremuloides*, and are highly suitable for the process of the present invention.

The process of the present invention is carried out as follows.

Comparatively large particles of wood, preferably of debarked coniferous or nonconiferous wood, generally in a size of about (15-50) mm×(15-50) mm×about (6-12) mm, are typically produced using customary mechanical methods, for example by hogging. These comparatively large particles of wood are known herein and among those skilled in the art as hogged chips or just chips. The chips may be pretreated with chemicals, for example sodium hydrogensulfite ($NaHSO_3$), sodium sulfite ($Na_2SO_3$) and/or water, before further processing.

The chips are then delaminated in step a). Delamination comprises the chips typically being first (i) exposed to mechanical pressure and/or shearing forces and then (ii) ground under relatively benign conditions, for example in a refiner.

This procedure turns the chips into modified particles of wood, which are typically loose bundles of fiber, which typically have a longitudinal dimension in the range from 5 cm to 0.3 cm and which generally have a substantially enlarged surface area compared with the chips used.

A refiner is typically a grinding assembly of rotating and optionally fixed blades or preferably disks for grinding fibrous stalks, and preferably consists of one or two metallic disks with a radial relief which are close together and form a gap therebetween. In a two disk refiner, only one disk may turn or both disks turn, typically in that case in opposite directions. The pressure in a refiner is typically atmospheric or superatmospheric. Refiners are known and are described at length in Lönnberg, in particular in chapters 6 and 7.

The preceding step a) (i) is typically carried out in a screw press, which is generally used to dewater and simultaneously prefiberize the comparatively large particles of wood. A particularly suitable apparatus for performing the above-recited step a) (i) is, for example, an Impressafiner from Andritz AG, Austria.

The preceding step a) (ii) is typically carried out in a refiner or some other suitable grinding assembly under relatively benign conditions, for example in a single disk refiner at a disk speed of 1800 rpm and a pressure of 2.4 bar. Refiner stage a) (ii) pressure and/or energy consumption are typically lower than the corresponding parameters for the refiner in step b). The energy consumption in a refiner is generally determined inter alia by the refiner disk speed and the size of the gap between the refiner disks. A particularly suitable apparatus for performing the above-recited step a) (ii) is an Andritz 36-1 CP Single Disk Refiner from Andritz AG, Austria.

In step b), then, the modified particles of wood from step a) are ground in a refiner—typically under harsher conditions, for example higher energy input and/or higher disk speed and/or higher pressure than in step a) (ii).

Step b) is typically carried out in a refiner under the following conditions, for example in a single disk refiner at a disk speed of 2300 rpm and a pressure of 5.2 bar. Refiner stage b) pressure and/or energy consumption are typically higher than the corresponding parameters for the refiner in step a) (ii). The energy consumption in a refiner is generally determined inter alia by the refiner disk speed and the size of the gap between the refiner disks. A particularly suitable apparatus for performing the above-recited step b) is an Andritz 36-1 CP Single Disk Refiner from Andritz AG, Austria.

Step b) may be followed by a further grinding step or two or more grinding steps in a refiner similarly to step b).

The stalk obtained in step b) is optionally treated, in a subsequent step c), with reductive or oxidative bleaching agents under otherwise customary methods known from wood fiber production, for example in a bleaching tower. Bleaching agents and bleaching processes relating to the production of mechanical woodpulp are described at length in for example Lönnberg, in particular in chapter 11.

Highly suitable oxidative bleaching agents for the process of the present invention include those having a peroxo grouping, for example hydrogen peroxide, alkali metal peroxides.

Highly suitable reductive bleaching agents for step c) of the process according to the present invention include, for example, salts of dithionous acid $H_2S_2O_4$, salts of sulfurous acid and the like, preferably composition Z, more preferably components Z1 or Z2 or Z3.

A composition Z is present during step a) and/or step b), said composition Z comprising one or more of the following components (Z1) to (Z3): a salt of dithionous acid $H_2S_2O_4$ (Z1), a dithionous acid or dithionous acid derivative generator compound, for example thiourea dioxide (also called formamidinesulfinic acid, $HN{=}C(NH_2)SO_2H$) in combination with lye, for example caustic soda lye (NaOH in water) (Z2), a salt of sulfurous acid $H_2SO_3$ (sulfite) plus sodium tetraborohydride ($NaBH_4$) (Z3) and also optionally additives (Z4).

Dithionous acid salt (Z1) preferably comprises the alkali metal salts, preferably the lithium, sodium or potassium salts, or alkaline earth metal salts, preferably the calcium or magnesium salts, of dithionous acid or mixtures thereof, self-evidently including the forms with crystal water or similar adducts. Particular preference is given to sodium dithionite ($Na_2S_2O_4$), self-evidently including the forms with crystal water or similar adducts.

A dithionous acid or dithionous acid derivative generator compound (Z2) comprises for example thiourea dioxide (also called formamidinesulfinic acid, $HN{=}C(NH_2)SO_2H$) in combination with lye, for example caustic soda lye (NaOH in water).

Component (Z3) comprises a salt, preferably an alkali metal salt, preferably the lithium, sodium or potassium salt, or an alkaline earth metal salt, preferably the calcium or magnesium salt, of sulfurous acid ($H_2SO_3$), i.e., sulfites, or mixtures thereof, self-evidently including the forms with crystal water or similar adducts, each in combination with sodium tetraborohydride. Particular preference is given to the combination of sodium sulfite ($Na_2SO_3$), self-evidently including the forms with crystal water or similar adducts, with sodium tetraborohydride ($NaBH_4$).

Component (Z4) is one or more of the following components (1) to (4) and also optionally further added substances: (1) complexing agents, for example EDTA, polyphosphates, for example sodium tripolyphosphate and/or potassium tripolyphosphate; (2) basic compounds, preferably basic salts such as carbonates or hydrogencarbonates, for example basic salts such as carbonates or hydrogencarbonates of alkali metals or alkaline earth metals, preferably lithium carbonate, sodium carbonate, potassium carbonate or an alkaline earth metal carbonate, preferably calcium carbonate or magnesium carbonate, more preferably sodium carbonate ($Na_2CO_3$), self-evidently including the forms with crystal water or similar adducts in each case; (3) an alkali metal salt, preferably the lithium, sodium or potassium salt, or an alkaline earth metal salt, preferably the calcium or magnesium salt, of disulfurous acid ($H_2S_2O_5$); (4) an alkali metal salt, preferably the lithium, sodium or potassium salt, or an alkaline earth metal salt, preferably the calcium or magnesium salt, of sulfurous acid ($H_2SO_3$), more preferably sodium sulfite ($Na_2SO_3$).

Further added substances for component (Z4) comprise: surface-active substances such as anionic, cationic or nonionic or glucose-containing surfactants, typically in a proportion ranging from 1 wt % to 10 wt %, based on the composition Z; also scale control substances such as polyacrylates in a proportion ranging from 1 wt % to 10 wt %, based on composition Z.

In a preferred embodiment (I) said composition Z comprises a salt of dithionous acid $H_2S_2O_4$ (Z1), preferably a sodium salt, potassium salt, calcium salt, magnesium salt of dithionous acid, mixtures of these salts also being included, more preferably sodium dithionite, the above-described components (Z1) each more preferably in the range from 20 to 95 wt %, most preferably 60 to 95 wt %, all based on composition Z.

In a further preferred embodiment (II) said composition Z comprises firstly a salt of dithionous acid $H_2S_2O_4$ (Z1), preferably a sodium salt, potassium salt, calcium salt, magnesium salt of dithionous acid, mixtures of these salts also being included, more preferably sodium dithionite, the above-described components (Z1) each more preferably in the range from 60 to 95 wt %, all based on composition Z, and also component (Z4), more preferably thereof (1) complexing agents polyphosphates, (2) basic salts such as carbonates or hydrogencarbonates of alkali metals or alkaline earth metals, such as sodium carbonate; (3) an alkali metal salt of disulfurous acid ($H_2S_2O_5$); (4) an alkali metal salt of sulfurous acid ($H_2SO_3$), preferably (Z1) at from 60 to 95 wt % and (Z4) at from 5 to 40 wt %, all based on composition Z.

In a further preferred embodiment (III) said composition Z comprises 60 to 95 wt % of a sodium salt (Z1), preferably sodium dithionite; 1 to 25 wt % of a sulfite Z4(4), preferably sodium sulfite; 1 to 10 wt % of a carbonate and/or of a bicarbonate, each of alkali metals Z4(2), preferably sodium carbonate; 0 to 10 wt % of a complexing agent Z4(1), preferably sodium tripolyphosphate; all based on composition Z subject to the proviso that the components mentioned sum to 100%.

In a further preferred embodiment (IV) said composition Z in addition to one or more of components (Z1) to (Z3) and also one or more components Z4(1), Z4(3) and Z4(4) comprises such an amount of basic compounds Z4(2), preferably basic salts such as carbonates or hydrogencarbonates, for example basic salts such as carbonates or hydrogencarbonates of alkali metals or alkaline earth metals, preferably lithium carbonate, sodium carbonate, potassium carbonate or an alkaline earth metal carbonate, preferably calcium carbonate or magnesium carbonate, more preferably sodium carbonate, that these basic compounds act as acid buffers.

In a further preferred embodiment (V) said composition Z in addition to component (Z1)—preferably a sodium salt, potassium salt, calcium salt, magnesium salt of the dithionous acid, mixtures of these salts also being included, more preferably sodium dithionite—and also one or more components Z4(1), Z4(3) and Z4(4) comprises such an amount of basic compounds Z4(2), preferably basic salts such as carbonates or hydrogencarbonates, for example basic salts such as carbonates or hydrogencarbonates of alkali metals or alkaline earth metals, preferably lithium carbonate, sodium carbonate, potassium carbonate or an alkaline earth metal carbonate, preferably calcium carbonate or magnesium carbonate, more preferably sodium carbonate, that these basic compounds act as acid buffers.

Composition Z is typically used in the process of the present invention in the form of a solution or suspension, but it may also be used without further solvents or diluents, as a pure substance.

Suitable solvent or dispersant media dissolve or disperse said composition Z without its active ingredient or ingredients, in particular component Z1, being rendered inactive or much used in their activity by decomposition or otherwise. Examples are water-containing solvent or dispersant media, for example mixtures of water and protic or aprotic organic solvents, for example alcohols, or ethers, ketones. Water is a preferred solvent or dispersant medium.

The concentration of composition Z in such solutions or dispersions is generally in the range from 1 to 30 wt %, preferably from 5 to 20 wt %, all based on the mass of the solution or dispersion.

The amount of component (Z1) or (Z2) or (Z3), preferably the amount of component (Z1), more preferably the amount of sodium dithionite, per kilogram of wood material to be treated, for example chips or modified particles of wood, is in the range from 1 to 50 grams, preferably in the range from 5 to 20 grams.

The solution or dispersion described above, including its preferred embodiments, is preferably used and prepared as fresh as possible or alternatively kept in the substantially complete absence of oxidizing media, for example atmospheric oxygen.

It is typically before step a (i), or step (a) (ii) or during the practice of step a) (i) and/or step a) (ii) and/or before step b) and/or during the practice of step b) that said composition Z is brought into contact with the corresponding (modified) particles of wood.

To this end, a composition Z solution or dispersion more particularly described above, including its preferred embodiments, preferably a solution or dispersion of Z in water, is usually metered into the line bringing the particles of wood to the corresponding apparatuses in which steps a) (i), a) (ii), or b) are carried out, preferably in the flow direction of the particles of wood or of the modified particles of wood, just upstream of the corresponding apparatus. Additionally or alternatively to this procedure, a composition Z solution or dispersion more particularly described above may be typically metered directly into the space of the corresponding apparatuses in which steps a) (i), a) (ii) or b) are carried out.

In one highly suitable embodiment, a Z-in-water dispersion or solution more particularly described above, including its preferred embodiments, is metered for example into the refiner of stage a) (ii) and/or the refiner of stage b).

The present invention also provides a process for producing paper, preferably tissue, newsprint paper, magazine paper or paper for board or card production, wherein a bleached mechanical woodpulp is produced as described herein and further processed into paper, preferably tissue, newsprint paper, magazine paper or paper for board or card production, typically using the familiar papermaking processes.

The present invention also provides a process for producing light-colored wood-base materials, preferably HDF or MDF wood-base materials, wherein bleached mechanical woodpulp is produced as described herein and resonated, optionally under addition of white pigments, and compression molded into the wood-base materials.

The present invention also provides a bleached mechanical woodpulp obtainable by a process as described herein.

The present invention also provides for the use of bleached mechanical woodpulp obtainable by the process described herein for producing paper or wood-base materials.

The process of the present invention is notable for reduced refiner energy consumption and for providing a mechanical woodpulp where the degree of bleaching is higher than in the comparable prior art. Refiner energy consumption, the mechanical woodpulp's degree of bleaching and further physical parameters were determined using the methods described in the examples.

EXAMPLES

Black spruce wood (*Picea mariana*) and turpentine pine wood (*Pinus taeda*) were used.

The corresponding wood was debarked and hogged by customary mechanical methods into chips measuring about 5 cm×5 cm×1 cm.

A) ATMP Variant (in Accordance with the Present Invention)

This raw material was further processed in the so-called ATMP process of Andritz AG (Austria) as described hereinbelow.

The chips were treated in a chip press (Impressafiner screw machine from Andritz AG, Austria) at a pressure of about 1.4 bar. The material thus treated was treated with water on emerging from the screw machine and fed into a refiner (Andritz 36-1CP from Andritz AG, Austria), a fiberizer having a single grinding disk (diameter 0.91 m), where it was converted into a fibrous material at a grinding disk speed of 1800 rpm and a pressure of 2.4 bar.

The material thus fiberized was fed into a first main refiner (Andritz 36-1CP) and converted therein at a grinding disk speed of 2300 rpm and a pressure of 5.2 bar in the presence of composition Z as described hereinbelow into mechanical woodpulp.

An embodiment (III) solution of composition Z in water, comprising 10 wt % of sodium dithionite and 2 wt % of sodium carbonate, each based on the mass of the solution, was metered virtually directly into the grinding mechanism of the first main refiner, at a rate of 15 grams of pure sodium dithionite per kilogram of fiberized material (oven dry "OD").

This mechanical woodpulp was ground further in a second main refiner having two grinding disks (Andritz 401) at atmospheric pressure.

B) TMP Variant (for Comparison)

The comparative tests (conventional TMP process) were carried out similarly to the inventive tests (variant A) except that inventive step a) was not performed and the chips (see above) were ground directly into mechanical woodpulp in a first main refiner (Andritz 36-1CP from Andritz AG, Austria) at a pressure of 3.45 bar and a disk speed of 1800 rpm, in the presence of a composition Z-in-water solution as described above under A). This mechanical woodpulp was ground further in a second main refiner having two grinding disks (Andritz 401 from Andritz AG, Austria) at atmospheric pressure.

C) General

Specific energy consumption is reported in kWh per OD metric ton (to), where OD is oven dry. Specific energy consumption was determined as follows: The power consumption of the refiner within a given period was measured and divided by the mass of the fiberized OD material.

The mechanical parameters of the mechanical woodpulp samples and the brightness were measured using standard TAPPI test methods: http://www.tappi.org.

Brightness was determined using Tappi T 452.

Tensile Index was determined using Tappi T 456.

Tear Index was determined using Tappi T 414.

Tensile Energy Absorption (TEA) was determined using Tappi T 494,

The Light Scattering Coefficient was determined using ISO 9416.

Mechanical woodpulp fractionation was carried out using a Bauer Mc Nett Classifier.

The analysis for shiver was carried out using a Pulmac Shive Analyzer equipped with a 0.10 mm sieve plate.

Example 1

ATMP Variant A) and Comparative Variant B) Using Black Spruce Wood

The mechanical woodpulp obtained from black spruce wood by variant A) as described was processed with a standard laboratory sheet former to TAPPI T 205 into test paper and certain mechanical properties determined thereon, and the optical properties (brightness for example) were measured on sheets of paper which were produced to TAPPI T 218.

For comparison, mechanical woodpulp obtained by variant B) as described was processed into test paper as described above and tested using the methods described above.

The results are shown in table 1.

Mechanical woodpulp properties were standardized to a freeness of 200 ml for the aqueous pulp.

TABLE 1

| Parameter | Units | Variant A) | Variant B) (for comparison) |
|---|---|---|---|
| Specific Energy Consumption | kWh/to | 1648 | 1984 |

TABLE 1-continued

| Parameter | Units | Variant A) | Variant B) (for comparison) |
|---|---|---|---|
| Tensile Index | Nm/g | 41.8 | 33.9 |
| Tear Index | $mNm^2/g$ | 9.8 | 8.1 |
| Tensile Energy Absorption (TEA) | $J/m^2$ | 37.9 | 25.6 |
| Light Scattering Coefficient | $m^2/kg$ | 54.0 | 52.5 |
| Shives | % | 1.6 | 1.2 |
| Brightness | % | 68.6 | 65.5 |

Example 2

ATMP Variant A) and Comparative Variant B) Using Turpentine Pine Wood

The mechanical woodpulp obtained from turpentine pine wood by variant A) as described was used to produce test paper as described in Example 1 and to determine specific properties thereon using the methods described in Example 1.

For comparison, mechanical woodpulp obtained from turpentine pine wood by variant B) as described was processed into test paper as described in Example 1 and examined using the methods described in Example 1.

The results are shown in Table 2

Mechanical woodpulp properties were standardized to a freeness of 200 ml for the aqueous pulp.

| Parameter | Units | Variant A) | Variant B) (for comparison) |
|---|---|---|---|
| Specific Energy Consumption | kWh/to | 1440 | 1648 |
| Tensile Index | Nm/g | 25.7 | 25.6 |
| Tear Index | $mNm^2/g$ | 8.7 | 8.7 |
| Tensile Energy Absorption (TEA) | $J/m^2$ | 18.3 | 17.0 |
| Light Scattering Coefficient | $m^2/kg$ | 42.6 | 43.5 |
| Shives | % | 0.15 | 1.16 |
| Brightness | % | 61.4 | 58.9 |

The examples show that the process of the present invention is more energy-saving while at the same time leading to bleached mechanical woodpulp having higher brightness and better mechanical properties.

We claim:

1. A process for producing bleached mechanical woodpulp, said process comprising the steps of a) delaminating large particles of wood, which have optionally been pretreated with chemicals and/or water, into modified particles of wood, b) grinding the modified particles of wood from a) in one or more refiners, and c) treating the stock obtained in step b) with oxidative or reductive bleaching agents, wherein a composition Z is present during step a) or both step a) and step b), said composition Z comprising a carbonate or hydrogencarbonate of alkali or alkaline earth metal and one or more of the following one or more of the following components (Z1) to (Z3): a salt of dithionous acid $H_2S_2O_4$(Z1), a dithionous acid or dithionous acid derivative generator compound (Z2), a salt of sulfurous acid (sulfite) plus sodium tetraborohydride (Z3) and also optionally additives (Z4) and wherein step a) comprises the large, optionally pretreated particles of wood being first (i) exposed to mechanical pressure and/or shearing forces and then (ii) ground in a refiner, wherein refiner stage a) (ii) pressure and/or energy consumption are lower than the corresponding parameters for the refiner in step b) and wherein Z is metered into the refiner of stage a) (ii), or both stage a) (ii) and b), and said large particles of wood, are a size of about (15-50) mm×(15-50) mm×about (6-12) mm, wherein the amount of component(Z1) or (Z2) or (Z3) per kilogram of modified particles of wood is in the range from 1 to 50 grams.

2. The process according to claim 1, wherein said composition Z comprises a salt of dithionous acid $H_2S_2O_4$(Z1).

3. The process according to claim 2, wherein the salt of dithionous acid $H_2S_2O_4$ is an alkali metal salt of dithionous acid $H_2S_2O_4$.

4. The process according to claim 2, wherein the salt of dithionous acid $H_2S_2O_4$ is sodium dithionite.

5. The process according to claim 4, wherein the large particles of wood are of debarked coniferous or nonconiferous wood.

6. The process according to claim 5, which requires additives Z4.

7. The process according to claim 1, wherein the large particles of wood are of debarked coniferous or nonconiferous wood.

8. The process according to claim 1, wherein which requires additives Z4.

9. The process according to claim 1, wherein said composition Z comprises Z1 wherein Z1 comprises calcium or magnesium salts, of dithionous acid or mixtures thereof.

10. The process according to claim 1, wherein said composition Z comprises Z2.

11. The process according to claim 1, wherein said composition Z comprises Z2 wherein Z2 comprises thiourea dioxide in combination with lye.

12. The process according to claim 10, said composition Z comprises Z3.

13. The process according to claim 1, wherein said composition Z comprises Z3 wherein Z3 comprises calcium or magnesium salt, of sulfurous acid ($H_2SO_3$), in combination with sodium tetraborohydride.

14. The process according to claim 1, wherein said composition Z comprises Z3 wherein Z3 comprises the combination of sodium sulfite ($Na_2SO_3$) with sodium tetraborohydride ($NaBH_4$).

* * * * *